US008545752B2

(12) United States Patent
Maggioli et al.

(10) Patent No.: US 8,545,752 B2
(45) **Date of Patent: *Oct. 1, 2013**

(54) COOLING PLATE FOR A METALLURGICAL FURNACE

(75) Inventors: Nicolas Maggioli, Thionville (FR); Paul Tockert, Berbourg (LU); Nicolas Mousel, Dudelange (LU); Claude Pleimelding, Platen (LU)

(73) Assignee: Paul Wurth S.A., Luxembourg (LU)

( * ) Notice: Subject to any disclaimer, the term of this patent is extended or adjusted under 35 U.S.C. 154(b) by 143 days.

This patent is subject to a terminal disclaimer.

(21) Appl. No.: 12/995,215

(22) PCT Filed: Jun. 4, 2009

(86) PCT No.: PCT/EP2009/056846

§ 371 (c)(1),
(2), (4) Date: Nov. 30, 2010

(87) PCT Pub. No.: WO2009/147192

PCT Pub. Date: Dec. 10, 2009

(65) Prior Publication Data

US 2011/0104513 A1 May 5, 2011

(30) Foreign Application Priority Data

Jun. 6, 2008 (LU) ..... 91454

(51) Int. Cl.
*C21B 7/10* (2006.01)

(52) U.S. Cl.
USPC ..... 266/194; 266/193

(58) Field of Classification Search
USPC ..... 266/193, 194
See application file for complete search history.

(56) References Cited

U.S. PATENT DOCUMENTS

| | | | | |
|---|---|---|---|---|
| 4,437,651 | A | 3/1984 | Cordier et al. | |
| 6,742,699 | B2 * | 6/2004 | Saarinen et al. | 266/193 |
| 6,911,176 | B2 * | 6/2005 | Saarinen | 266/193 |
| 2012/0056361 | A1 * | 3/2012 | Maggioli et al. | 266/241 |

FOREIGN PATENT DOCUMENTS

| | | |
|---|---|---|
| CN | 2461931 Y | 11/2001 |
| CN | 2479025 | 2/2002 |
| DE | 7331936 U | 2/1974 |
| DE | 2907511 C2 | 9/1980 |

(Continued)

OTHER PUBLICATIONS

International Search Report PCT/EP2009/056846; Dated Sep. 21, 2009.

(Continued)

*Primary Examiner* — Scott Kastler
(74) *Attorney, Agent, or Firm* — Cantor Colburn LLP

(57) ABSTRACT

A cooling plate (10) for a metallurgical furnace in accordance with the present invention has a panel-like body (12) with a front face (14) and an opposite rear face (16), an upper edge (22) and an opposite lower edge (24), and a first side edge (18) and an opposite second side edge (20). The front face (14) is provided with grooves (32) extending between the first and second edges (18, 20), the grooves (32) forming lamellar ribs (34) on the front face (14), each rib (34) having a crest (37) and adjoining sidewalls (39, 39'), a base (38) being arranged in the groove (32) between two neighboring ribs (34). In accordance with an important aspect of the present invention, at least one of the grooves (32) is provided with a metal insert (40) arranged against at least one of the sidewalls (39, 39').

19 Claims, 3 Drawing Sheets

(56) References Cited

FOREIGN PATENT DOCUMENTS

| | | | |
|---|---|---|---|
| EP | 0052039 | A1 | 5/1982 |
| FR | 2169649 | A | 9/1973 |
| JP | 56010292 | U | 1/1981 |
| JP | 63192805 | A | 8/1988 |
| JP | 63192806 | A | 8/1988 |
| MX | PA02009128 | A | 3/2003 |
| MX | PA03003763 | A | 8/2003 |
| WO | 0063446 | A1 | 10/2000 |

OTHER PUBLICATIONS

International Search Report and Written Opinion issued Aug. 31, 2010 re: PCT/EP2010/054770: citing: EP 0 052 039 A1, DE 73 31 936 U, JP 56 010292 U, FR 2 169 649 A and WO 00/63446 A1.

* cited by examiner

COOLING PLATE FOR A METALLURGICAL FURNACE

TECHNICAL FIELD

The present invention generally relates to a cooling plate for a metallurgical furnace.

BACKGROUND

Such cooling plates for a metallurgical furnace, also called staves, are well known in the art. They are used to cover the inner wall of the outer shell of the metallurgical furnace, as e.g. a blast furnace or electric arc furnace, to provide: (1) a heat evacuating protection screen between the interior of the furnace and the outer furnace shell; and (2) an anchoring means for a refractory brick lining, a refractory guniting or a process generated accretion layer inside the furnace. Originally, the cooling plates have been cast iron plates with cooling pipes cast therein. As an alternative to cast iron staves, copper staves have been developed. Nowadays most cooling plates for a metallurgical furnace are made of copper, a copper alloy or, more recently, of steel.

A copper cooling plate for a blast furnace is e.g. disclosed in German patent DE 2907511 C2. It comprises a panel-like body having a hot face (i.e. the face facing the interior of the furnace) that is subdivided by parallel grooves into lamellar ribs. The object of these grooves and ribs, which preferably have a dovetail (or swallowtail) cross-section and are arranged horizontally when the cooling plate is mounted on the furnace wall, is to anchor a refractory brick lining, a refractory guniting material or a process generated accretion layer to the hot face of the cooling plate. Drilled cooling channels extend through the panel-like body in proximity of the rear face, i.e. the cold face of the cooling plate, perpendicularly to the horizontal grooves and ribs.

The refractory brick lining, the refractory guniting material or the process generated accretion layer forms a protective layer arranged in front the hot face of the panel-like body. This protecting layer is useful in protecting the cooling plate from deterioration caused by the harsh environment reigning inside the furnace. In practice, the furnace is however also occasionally operated without this protective layer, resulting in erosion of the lamellar ribs of the hot face. This erosion hinders the subsequent anchoring power of the lamellar ribs and reduces cooling capacity of the cooling plates.

BRIEF SUMMARY

The invention provides an improved cooling plate for a metallurgical furnace, wherein the cooling plate does not display the aforementioned drawbacks.

A cooling plate for a metallurgical furnace in accordance with the present invention has a panel-like body with a front face and an opposite rear face, an upper edge and an opposite lower edge, and a first side edge and an opposite second side edge. The front face is provided with grooves extending between the first and second edges, the grooves forming lamellar ribs on the front face, each rib having a crest and adjoining sidewalls, a base being arranged in the groove between two neighboring ribs. In accordance with an important aspect of the present invention, at least one of the grooves is provided with a metal insert arranged against at least one of the sidewalls.

Due to the metal insert covering the sidewall of the rib, the latter is protected from erosion. When, as is occasionally the case, the furnace is operated without protection layer (refractory brick lining, guniting or accretion layer) covering the cooling panels, the metal insert largely prevents material from the rib being removed by the harsh conditions in the furnace. The metal insert hence allows to slow down deterioration of the cooling panel and thereby prolongs its lifetime. Also, by providing such a metal insert, the anchoring function of the front face is maintained for subsequently attaching a protection layer to the cooling plate.

Preferably, the metal insert is removably arranged in the groove of the cooling plate. Indeed, should the metal insert be damaged, it may then be removed from the cooling plate and replaced with a new one.

The metal insert may be made from steel, preferably high wear resistant steel. Examples of such high wear resistant steels are Creusabro® or Hardox®.

The metal insert is preferably made from sheet metal so as to easily conform to the exact shape of the sidewall.

To warrant a good anchoring function of the lamellar ribs and grooves structure on the front face of the cooling plate and a good thermal form stability of the cooling plate, the width of a groove is preferably narrower at its inlet than at its base. In a preferred embodiment of the cooling plate in accordance with the present invention, a groove has a dovetail cross-section. The mean width of a groove is preferably at least 40 mm and this width is preferably equal to or bigger than the mean width of a lamellar rib.

It should however be noted that cooling plates may also be provided with grooves of different cross-section, such as e.g. rectangular cross-section.

According to a first preferred embodiment of the invention, the metal insert comprises a first insert portion covering a first sidewall of a groove and a second insert portion covering a second sidewall of the groove. Both sidewalls of the groove are thereby protected.

The metal insert preferably comprises a bridge connecting the first insert portion with the second insert portion, such as to maintain the two insert portions in a particular relation to one another. This ensures that the insert portions are tightly connected to their respective sidewalls.

The bridge may e.g. be formed by a plurality of intermittent connecting elements, the connecting elements connecting the first and second insert portions over at least part of the length of the metal insert.

Preferably, however, the bridge is formed as a third insert portion covering the base of the groove. Such a bridge may be formed in one piece with the first and second insert portions. Alternatively, the bridge may be connected to the first and second insert portions by welding.

According to a second preferred embodiment of the invention, the metal insert comprises a protruding edge extending out of the groove, the protruding edge being shaped so as to cover a portion of the crest of the rib. This provides further protection for the crest of the rib.

According to a third preferred embodiment of the invention, an edge groove located closest to the upper/lower edge comprises a metal insert having an extended portion shaped so as to cover the crest of the rib between the edge groove and the upper/lower edge. The extended portion may further be shaped so as to further cover the upper/lower edge.

Preferably, the metal insert extends over the whole length of the groove. A single metal insert can hence used for protecting the sidewalls of the whole groove. It may, in some circumstances, however be preferable to provide shorter metal inserts, wherein a plurality of such shorter metal inserts may then be used to cover the whole or only part of a groove.

The metal insert is advantageously removably installed in the groove and may be connected in the groove by form-fit or by other means such as bolts or screws.

Preferably, the cooling plate is made of at least one of the following materials: copper, a copper alloy or steel.

BRIEF DESCRIPTION OF THE DRAWINGS

Preferred embodiments of the invention will now be described, by way of example, with reference to the accompanying drawings, in which.

DESCRIPTION OF PREFERRED EMBODIMENTS

Cooling plates are used to cover the inner wall of an outer shell of a metallurgical furnace, as e.g. a blast furnace or electric arc furnace. The object of such cooling plates is to form: (1) a heat evacuating protection screen between the interior of the furnace and the outer furnace shell; and (2) an anchoring means for a refractory brick lining, a refractory guniting or a process generated accretion layer inside the furnace.

Figure 1:
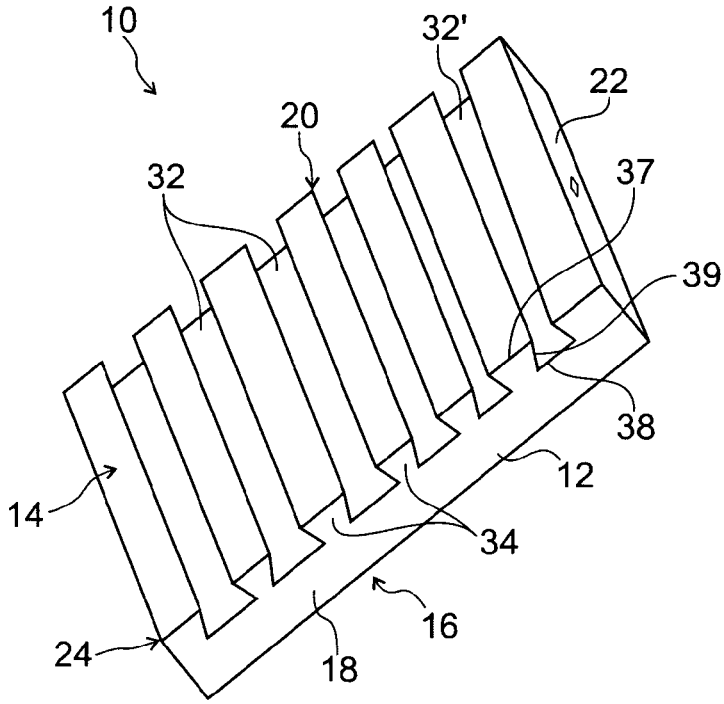
FIG. 1 is a simplified perspective view of a cooling panel according to the invention.

Referring now to FIG. 1, it will be noted that the cooling plate 10 has a panel-like body 12, which is e.g. made of a cast or forged body of copper, a copper alloy or steel. This panel-like body 12 has a front face 14, also referred to as hot face, which will be facing the interior of the furnace, and a rear face 16, also referred to as cold face, which will be facing the inner surface of the furnace wall. The panel-like body 12 generally has the form of a quadrilateral with a pair of long first and second edges 18, 20 and a pair of short upper and lower edges 22, 24. Most modern cooling plates have a width in the range of 600 to 1300 mm and a height in the range of 1000 to 4200 mm. It will however be understood that the height and width of the cooling plate may be adapted, amongst others, to structural conditions of a metallurgical furnace and to constraints resulting from their fabrication process.

The cooling plate 10 further comprises connection pipes (not shown) on the rear face 16 for circulating a cooling fluid, generally water, through cooling channels (not shown) arranged within the panel-like body 12.

It will be noted that the front face 14 is subdivided by means of grooves 32 into lamellar ribs 34. Normally, the grooves 32 laterally delimiting the lamellar ribs 34 are directly cast into the panel-like body 12. Exceptionally, these grooves 32 may also be milled into the front face 14 of the panel-like body 12. As seen in FIG. 1, the lamellar ribs 34 extend parallel to the upper and lower edges 22, 24, from the first edge 18 to the second edge 20 of the panel-like body 12. When the cooling plate 10 is mounted in the furnace, the grooves 32 and lamellar ribs 34 are arranged horizontally. They form anchorage means for anchoring a refractory brick lining, a refractory guniting or a process generated accretion layer to the front face 14.

A preferred geometry of the grooves 32 and lamellar ribs 34, which warrants an excellent anchoring to the front face 14 for a refractory brick lining, a refractory guniting material or a process formed accretion layer, is also illustrated in FIG. 1. It will be noted that the grooves 32 have a dovetail (or swallowtail) cross-section, i.e. the inlet width of a groove 32 is narrower than the width at its base 38. Consequently, the ribs 34 have, with regard to the grooves 32, an inverse dovetail (or inverse swallowtail) cross-section, i.e. the width at a crest 37 of the rib 34 is wider than the width at its base. The angle between a base 38 of a groove 32 and a sidewall 39 of a rib 34 is generally in the range of 70° to 85°. In order to provide a strong anchoring of a refractory brick lining, a guniting or an accretion layer in the front face 14, the mean width of a lamellar rib 34, measured at half the height of the lamellar rib 34, is preferably smaller than the mean width of a groove 32, measured at half the height of the groove 32. Typical values for the mean width of a groove 32 are e.g. in the range of 40 mm to 100 mm. Typical values for the mean width of a lamellar rib 34 are e.g. in the range of 20 mm to 40 mm. The height of the lamellar ribs 34 (which corresponds to the depth of the grooves 32) represents generally between 20% and 40% of the total thickness of the panel-like body 12.

Figure 2:
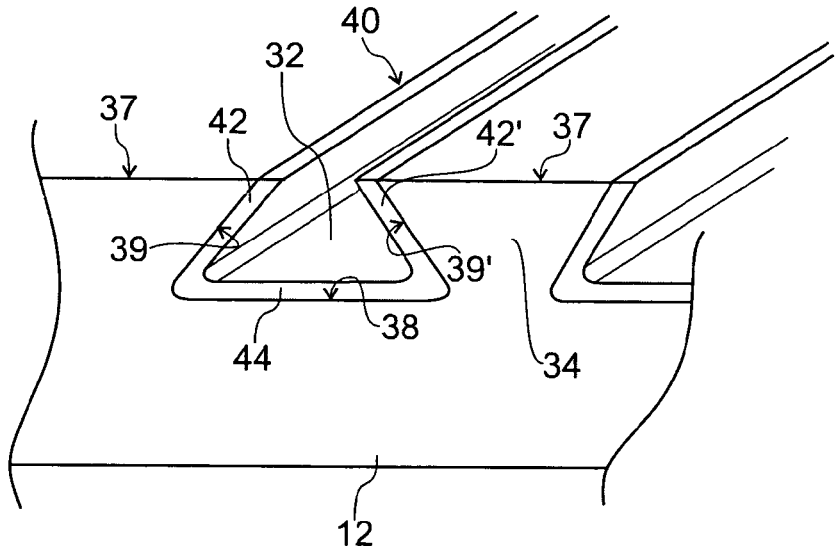
FIG. 2 is an enlarged view of a groove fitted with a metal insert according to a first embodiment of the invention.

According to the present invention, at least one of the grooves 32 is provided with a metal insert 40 arranged against at least one of the sidewalls 39. The metal insert is made from steel, preferably high wear resistant steel. Sheet metal may preferably be used to form the metal insert. It should however be noted that other metals may be used. A first embodiment of such a metal insert 40 is shown in FIG. 2. This metal insert 40 comprises a first insert portion 42 covering a first sidewall 39 of the groove 32 and a second insert portion 42' covering a second sidewall 39' of the groove 32. The first and second insert portions 42, 42' are connected together by means of a third insert portion 44 covering the base 38 of the groove 32. The metal insert 40 is formed in one piece from sheet metal and formed so as to conform exactly to the walls within the groove 32. In the embodiment shown in FIG. 2, the metal insert 40 is flush with the crests 37 of the ribs 34, i.e. the metal insert 40 covers the whole height of the sidewalls 39, 39' but does not protrude out of the groove 32. The metal insert 40 is formed so as to be immobilized in the groove 32 through form-fit. Alternatively other connection methods, such as e.g. bolts or screws may be provided to attach the metal insert 40 in the groove 32.

Due to the metal insert 40 covering the sidewalls 39, 39' of the ribs 34, the latter are protected from erosion. When, as is occasionally the case, the furnace is operated without protection layer (refractory brick lining, guniting or accretion layer) covering the cooling panels, the first and second insert portions 42, 42' largely prevent material from the ribs 34 being removed by the harsh conditions in the furnace. A slight deterioration of a central part of the crest 37 may still occur, but this deterioration is not particularly important.

The metal insert 40 is preferably removably arranged in the groove 32, such that replacement of worn or damaged metal inserts is possible. Indeed, once a cooling plate 10 has been removed from the inner wall of the outer shell of the metallurgical furnace, the metal insert 40 can be slid out of the groove 32 in a direction parallel to the groove 32. A replacement metal insert 40 can then be reinserted in the groove 32 before the cooling plate 10 is reinstalled.

Figure 3:
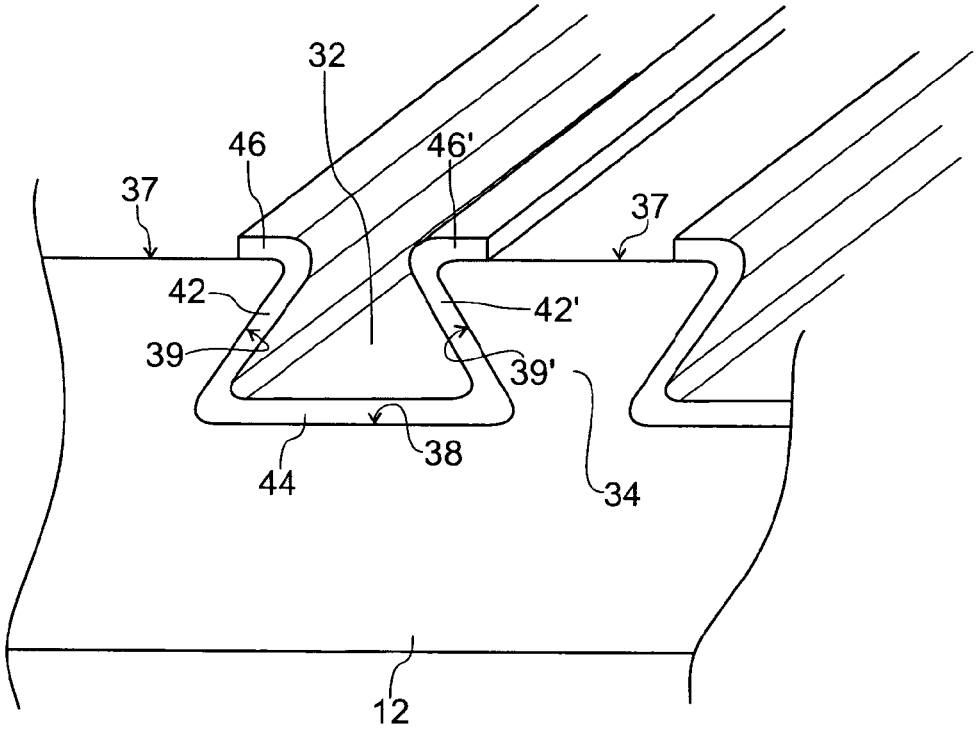
FIG. 3 is an enlarged view of a groove fitted with a metal insert according to a second embodiment of the invention.

A second embodiment of a metal insert is shown in FIG. 3. This metal insert is similar to the metal insert of FIG. 2 and will not be described in detail. In contrast to the metal insert of FIG. 2, the metal insert 40 according to this embodiment is not flush with the crests 37 of the ribs 34. Indeed, each of the first and second insert portions 42, 42' comprises a protruding edge 46, 46' extending out of the groove 32. The protruding edges 46, 46' are shaped so as to cover a portion of the crest 37 of the rib 34.

Figure 4:
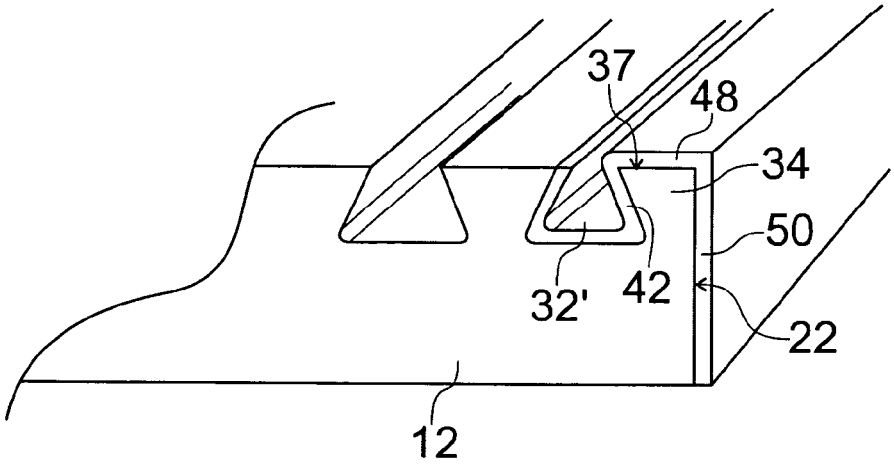
FIG. 4 is an enlarged view of a groove fitted with a metal insert according to a third embodiment of the invention.

A further embodiment of a metal insert is shown in FIG. 3. This metal insert is again similar to the metal insert of FIG. 2 but is designed to be used with an edge groove 32'. Such an edge groove 32' may e.g. be, as shown in FIG. 1 and 4 the groove closest to the upper edge 22. The metal insert 40 according to this embodiment comprises, on its second insert portion 42', an extended portion 48 shaped so as to cover the crest 37 of the rib 34 between the edge groove 32' and the upper edge 22. The extended portion 48 further comprises an edge portion 50 covering the upper edge 22.

Figure 5:
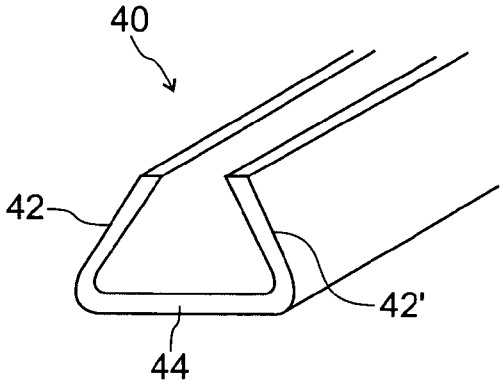
FIG. 5 is a perspective view of a metal insert constructed according to one aspect of the invention.
Figure 6:
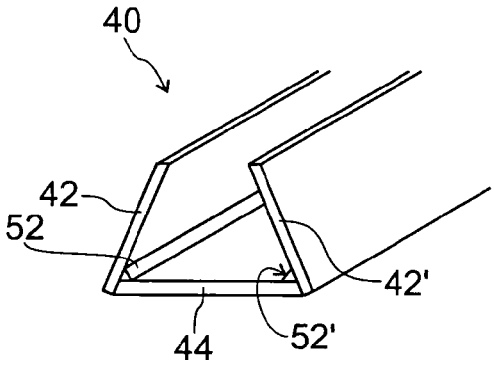
FIG. 6 is a perspective view of a metal insert constructed according to another aspect of the invention.
Figure 7:
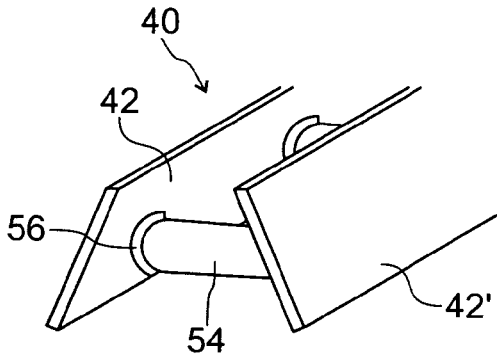
FIG. 7 is a perspective view of a metal insert constructed according to a further aspect of the invention.

The construction of the metal insert 40 will now be more closely described by referring to FIG. 5 to 7. The metal insert 40 may be formed, as shown in FIG. 5, in one piece from sheet material, wherein the sheet material is bent to form the first, second and third insert portions 42, 42', 44. According to FIG. 6, the metal insert 40 is formed by providing the first, second and third insert portions 42, 42', 44 as three separate pieces, which are then assembled and welded together. A first weld seam 52 is arranged between the first and third insert portions 42, 44 and a second weld seam 52' is arranged between the second and third insert portions 42', 44. According to a further embodiment, shown in FIG. 7, the metal insert 40 is formed by providing the first and second insert portions 42, 42' as two separate pieces. The first and second insert portions 42, 42' are maintained in their position against the respective sidewalls 39, 39' by means of intermittent connecting elements 54 arranged along the length of the metal insert 40. The connecting elements 54 can be connected to the first and second insert portions 42, 42' by means of a weld 56.

The invention claimed is:

1. A cooling plate for a metallurgical furnace, comprising: a panel-like body having a front face and an opposite rear face, an upper edge and an opposite lower edge, and a first side edge and an opposite second side edge, wherein said front face is provided with grooves extending between the first and second edges, the grooves forming lamellar ribs on said front face, each rib having a crest and adjoining sidewalls, a base being arranged in the groove between two neighboring ribs wherein at least one of said grooves is provided with a metal insert arranged against at least one of said sidewalls, said metal insert forming a hollow profile.

2. A cooling plate as claimed in claim 1, wherein said metal insert is made from steel.

3. A cooling plate as claimed in claim 1, wherein said metal insert is made from high wear resistant steel.

4. A cooling plate as claimed in claim 1, wherein said metal insert is made from sheet metal.

5. A cooling plate as claimed in claim 1, wherein said grooves are formed with a width that is narrower at an inlet of said groove than at said base of said groove.

6. A cooling plate as claimed in claim 5, wherein said grooves are formed with dovetail cross-section.

7. A cooling plate as claimed in claim 1, wherein said metal insert comprises a first insert portion covering a first sidewall of a groove and a second insert portion covering a second sidewall of said groove.

8. A cooling plate as claimed in claim 7, wherein said metal insert comprises a bridge connecting said first insert portion with said second insert portion.

9. A cooling plate as claimed in claim 8, wherein said bridge is formed by a plurality of intermittent connecting elements, said connecting elements connecting the first and second insert portions over at least part of the length of the metal insert.

10. A cooling plate as claimed in claim 8, wherein said bridge is formed as a third insert portion covering said base of said groove.

11. A cooling plate as claimed in claim 8, wherein said bridge is formed in one piece with said first and second insert portions.

12. A cooling plate as claimed in claim 8, wherein said bridge is connected to said first and second insert portions by welding.

13. A cooling plate as claimed in claim 1, wherein said metal insert comprises a protruding edge extending out of said groove, said protruding edge being shaped so as to cover a portion of said crest of said rib.

14. A cooling plate as claimed claim 1, wherein an edge groove located closest to said upper/lower edge comprises a metal insert having an extended portion shaped so as to cover said crest of said rib between said edge groove and said upper/lower edge.

15. A cooling plate as claimed in claim 14, wherein said extended portion is shaped so as to further cover said upper/lower edge.

16. A cooling plate as claimed in claim 1, wherein said metal insert extends over the whole length of said groove.

17. A cooling plate as claimed in claim 1, wherein said metal insert is removably installed in said groove.

18. A cooling plate as claimed in claim 1, wherein said metal insert is connected said groove by form-fit or by bolts or screws.

19. A cooling plate as claimed in claim 1, wherein said cooling plate is made of at least one of the following materials: copper, a copper alloy or steel.

* * * * *